US011427384B2

(12) United States Patent
Ramos et al.

(10) Patent No.: US 11,427,384 B2
(45) Date of Patent: Aug. 30, 2022

(54) INTERCHANGEABLE DISMOUNTABLE HINGED BOX FOR STORING CORE SAMPLES

(71) Applicants: Flávio De Barros Ramos, Porto Alegre (BR); Daniel Bortowski Carvalho, Crixás (BR)

(72) Inventors: Flávio De Barros Ramos, Porto Alegre (BR); Daniel Bortowski Carvalho, Crixás (BR)

( * ) Notice: Subject to any disclaimer, the term of this patent is extended or adjusted under 35 U.S.C. 154(b) by 167 days.

(21) Appl. No.: 16/810,286

(22) Filed: Mar. 5, 2020

(65) Prior Publication Data

US 2020/0283196 A1 Sep. 10, 2020

(30) Foreign Application Priority Data

Mar. 5, 2019 (BR) ..... 10 2019 004379 2

(51) Int. Cl.

| | |
|---|---|
| ***B65D 25/06*** | (2006.01) |
| ***B65D 85/20*** | (2006.01) |
| ***B65D 6/18*** | (2006.01) |
| ***E21B 25/00*** | (2006.01) |

(52) U.S. Cl.

CPC ..... *B65D 25/06* (2013.01); *B65D 11/1833* (2013.01); *B65D 85/20* (2013.01); *E21B 25/005* (2013.01)

(58) Field of Classification Search

CPC ..... B65D 11/1873; B65D 11/1883; B65D 25/06; B65D 19/02; B65D 19/06–18; B65D 19/44; B65D 43/022; B65D 7/24; B65D 7/26; B65D 85/20; B65D 9/12; B65D 9/14

USPC ..... 220/6, 529–552, 4.33

See application file for complete search history.

(56) References Cited

U.S. PATENT DOCUMENTS

| | | | | |
|---|---|---|---|---|
| 671,333 | A * | 4/1901 | Davy | B65D 9/14 217/15 |
| 3,093,259 | A * | 6/1963 | Morrison | B65D 81/3823 220/592.25 |
| 4,981,215 | A | 1/1991 | Ilic | |

(Continued)

FOREIGN PATENT DOCUMENTS

| | | |
|---|---|---|
| AU | 2010201733 | 5/2011 |
| JP | 2004268978 | 3/2003 |

(Continued)

*Primary Examiner* — Mollie Impink

(74) *Attorney, Agent, or Firm* — B. Aaron Schulman, Esq.; Stites & Harbison, PLLC

(57) ABSTRACT

An interchangeable dismountable hinged box for storing core samples is provided that is particularly used in the field of the collection of mineral materials, deriving from geological exploration activities, for subsequent analysis. The interchangeable dismountable hinged box has modular walls that can be fitted interchangeably with a base allowing for the hinging of these walls between a parallel position and a position perpendicular to the base. The box has at least one storage compartment for core samples defined between two modular transversal walls and two modular longitudinal walls, and may contain additional storage compartments, obtained by interlocking interchangeable partitions with modular walls. The box is adaptable for meeting the need for storing core samples of varying diameters.

8 Claims, 9 Drawing Sheets

(56) References Cited

U.S. PATENT DOCUMENTS

| | | | | |
|---|---|---|---|---|
| 5,632,392 | A * | 5/1997 | Oh | B65D 11/1833 220/7 |
| 5,746,342 | A * | 5/1998 | Jacques | B65D 1/246 220/6 |
| 9,981,778 | B2 * | 5/2018 | Plattner | B65D 25/06 |
| 2007/0062839 | A1 * | 3/2007 | Patterson | B65D 25/06 206/523 |
| 2008/0128428 | A1 * | 6/2008 | Beckerman | B65D 25/06 220/532 |
| 2012/0074823 | A1 * | 3/2012 | Bezich | B65D 21/00 312/240 |
| 2015/0195996 | A1 * | 7/2015 | Schall | B65D 85/52 47/65.5 |

FOREIGN PATENT DOCUMENTS

| | | |
|---|---|---|
| KR | 200395284 | 9/2005 |
| KR | 20080000703 | 4/2008 |

* cited by examiner

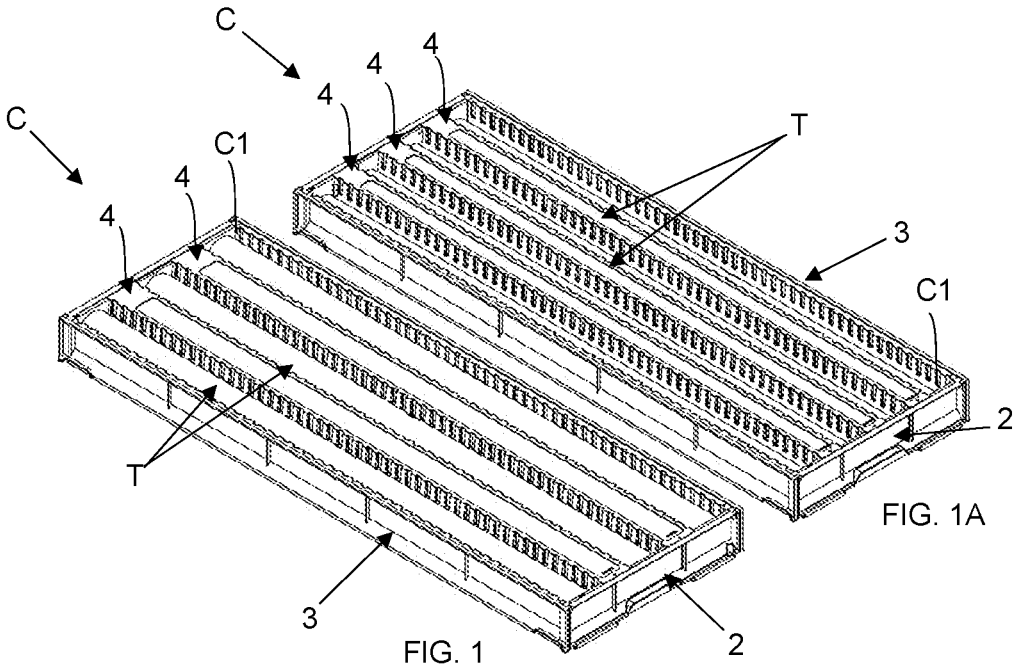
FIG. 1A
FIG. 1
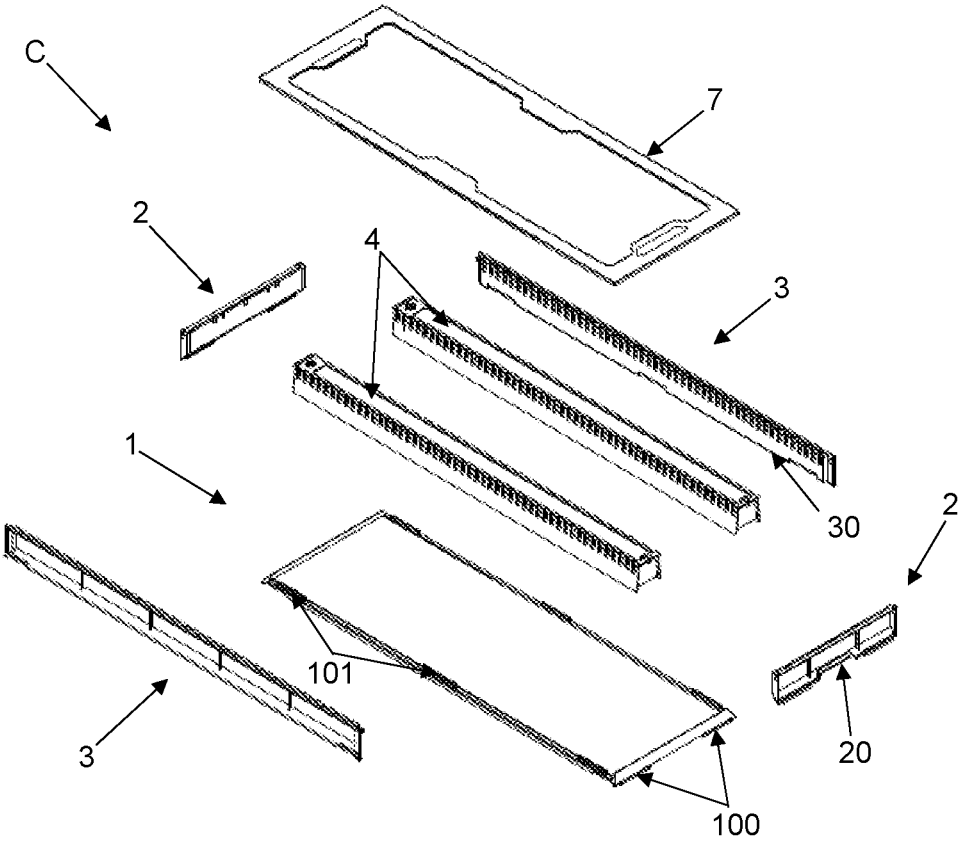
FIG. 2

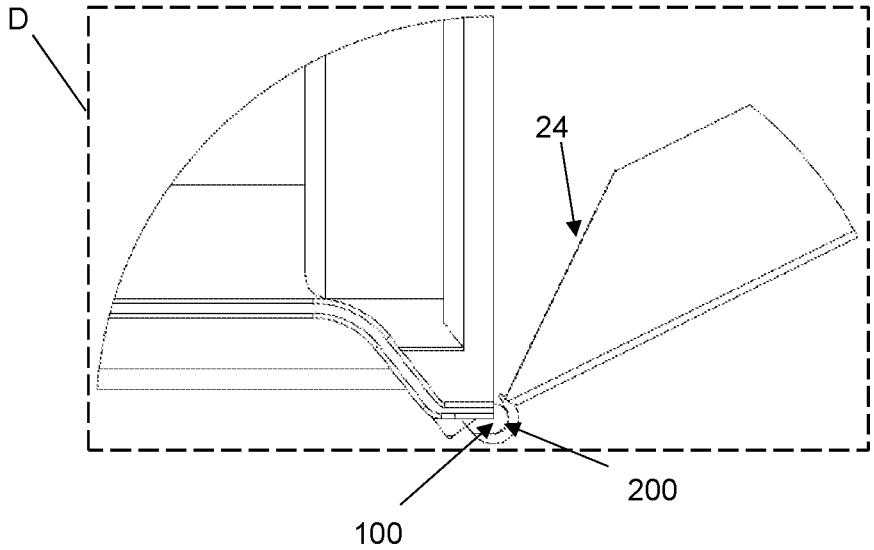
FIG. 10A
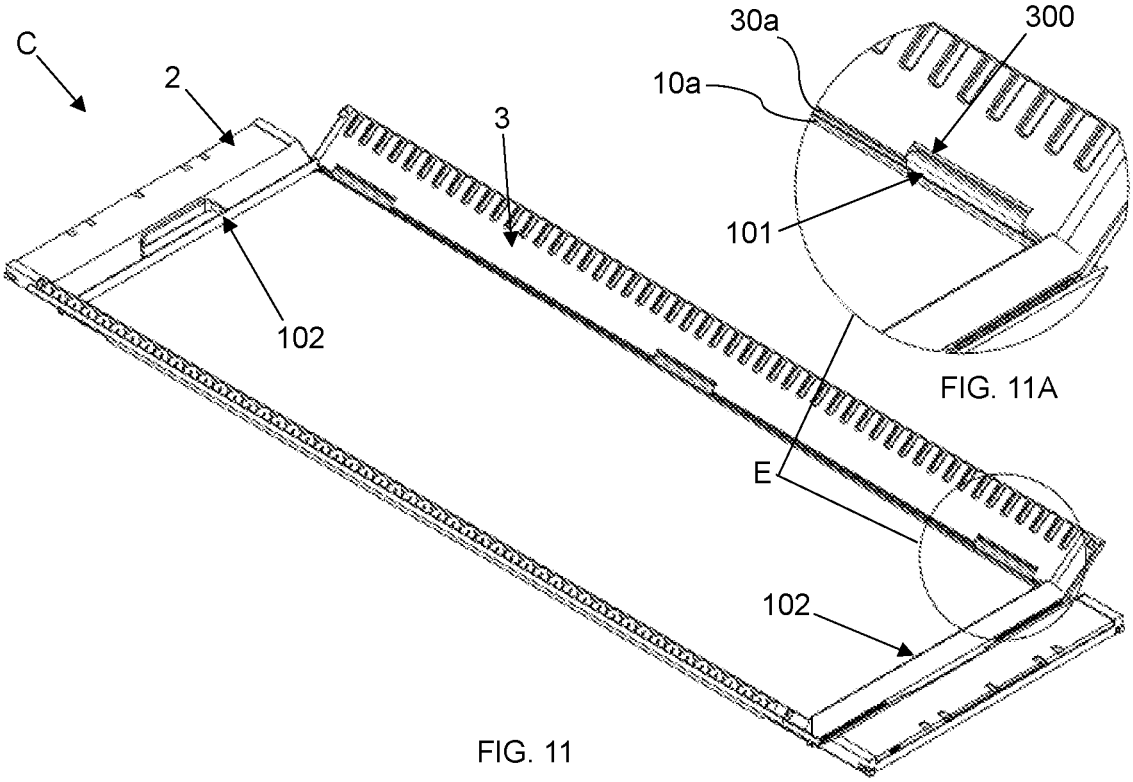
FIG. 11A
FIG. 11

INTERCHANGEABLE DISMOUNTABLE HINGED BOX FOR STORING CORE SAMPLES

The present application describes an interchangeable dismountable hinged box for storing core samples, specifically used in the field of the collection of mineral materials, deriving from activities of geological exploration, for subsequent analysis.

The invention reveals a box comprising connectable modular walls that are interchangeable with a base, allowing for the movement of these walls between a collapsed position, saving storage space and an extended position, for storing core samples of different sizes, depending on the dimensions of the modular walls fitted in the base.

The invention also proposes at least one interchangeable partition that makes the box easy to assemble and practical to use. In addition to this, each partition is enlarged and may comprise different dimensions that allow for the assembly of boxes with a number of compartments and adequate space to receive core samples of varying diameters.

Conveniently, the enlarged partitions, in addition to fulfilling the functions mentioned above, confer greater mechanical strength on the box when assembled, and also ensure greater dimensional stability during the manufacturing process of each partition.

The interchangeability occurs with the use of intuitive connecting means that facilitate the assembly and disassembly of the box, which simplifies the process of packing the samples, since the box is adaptable to the need to collect varying sizes of samples.

BACKGROUND OF THE INVENTION

Boxes for collecting core samples are known to the state of the art. Such boxes are manufactured from polymer and intended to provide greater durability and reliability for the storage of soil samples, in addition to allowing for the division of the inside of the box to form storage compartments for the core samples.

An example of a box for storing cores samples is presented by the Australian patent document AU2010201733A1, which teaches a box formed of a single body, comprising a base and walls, in addition to comprising a plurality of recesses intended to receive partition walls, which define spaces inside the box that are used as compartments for the storage of different core samples, with said partition walls being positioned in such a way as to allow for the storage of core samples of different diameters.

Thus, in a disadvantageous manner, this type of box occupies a large storage area when it is not being used to store core samples, since its body does not possess the means to be disassembled or folded. Thus, the single body of the box will always occupy the same space when it is being transported or stored without the core samples.

Furthermore, and also in a disadvantageous manner, these boxes of the state of the art do not have interchangeable walls, which allow for the use of modular components to form boxes of different dimensions, in accordance with the respective needs and use of said boxes. Thus, inconveniently, it is necessary to manufacture the bodies of these boxes in fixed sizes and, similarly, it is necessary for the end-customer to acquire boxes of different sizes so that it can store core samples of different sizes, increasing the costs of manufacturing and purchasing these boxes.

With a view to resolving these inconveniences, the present invention proposes an interchangeable dismountable hinged box for storing core samples, which comprises modular walls that can be fitted in an interchangeable manner with a base, allowing for the hinging of these walls between a collapsed position, for saving storage space, and an extended position, for storing core samples of different sizes.

Thus, one objective of this invention is to provide an interchangeable dismountable hinged box for storing core samples, which preferably comprises a single-sized base comprising modular fitting edges that can receive modular walls of different heights.

Another aim of this invention is to provide an interchangeable dismountable hinged box for storing core samples, which comprises structurally reinforced and flexible modular walls that simultaneously allow for sealing with the base of this box, when said walls are in an assembled position.

Another aim of this invention is to provide an interchangeable dismountable hinged box for storing core samples, which comprises modular internal partitions that can also have different dimensions and are interlocked with the modular walls of the box, while presenting an extended transversal section, to provide greater structural strength to this internal partition and the box itself.

Advantageously, the present invention presents an interchangeable dismountable hinged box for storing core samples which possesses components designed to fulfill the specific needs related to the correct storage of core samples, being easy to assemble and practical to use, reducing the costs of manufacturing and acquiring said boxes and simultaneously producing space gains in the transportation and storage of said boxes when they are empty.

Below are presented schematic figures of one particular embodiment of the invention, whose dimensions and proportions are not necessarily the real ones, since the figures simply have the purpose of didactically presenting their various aspects, whose scope is determined only by the scope of the attached claim.

BRIEF DESCRIPTION OF THE DRAWINGS

FIG. 1 illustrates a perspective view of a box (C) with 3 (three) compartments (C1) containing core samples (T);

FIG. 1*a* illustrates a perspective view of a box (C) equipped with 4 (four) compartments (C1) containing core samples (T);

FIG. 2 illustrates an exploded perspective view of the box (C);

FIG. 10A illustrates an enlarged view of detail "D" of FIG. 10;

FIG. 11 illustrates a perspective view of a box (C), showing the hinging of the modular walls (2 and 3);

FIG. 11A illustrates an enlarged view of detail "E" of FIG. 11;

DETAILED DESCRIPTION OF INVENTION

Figure 3:
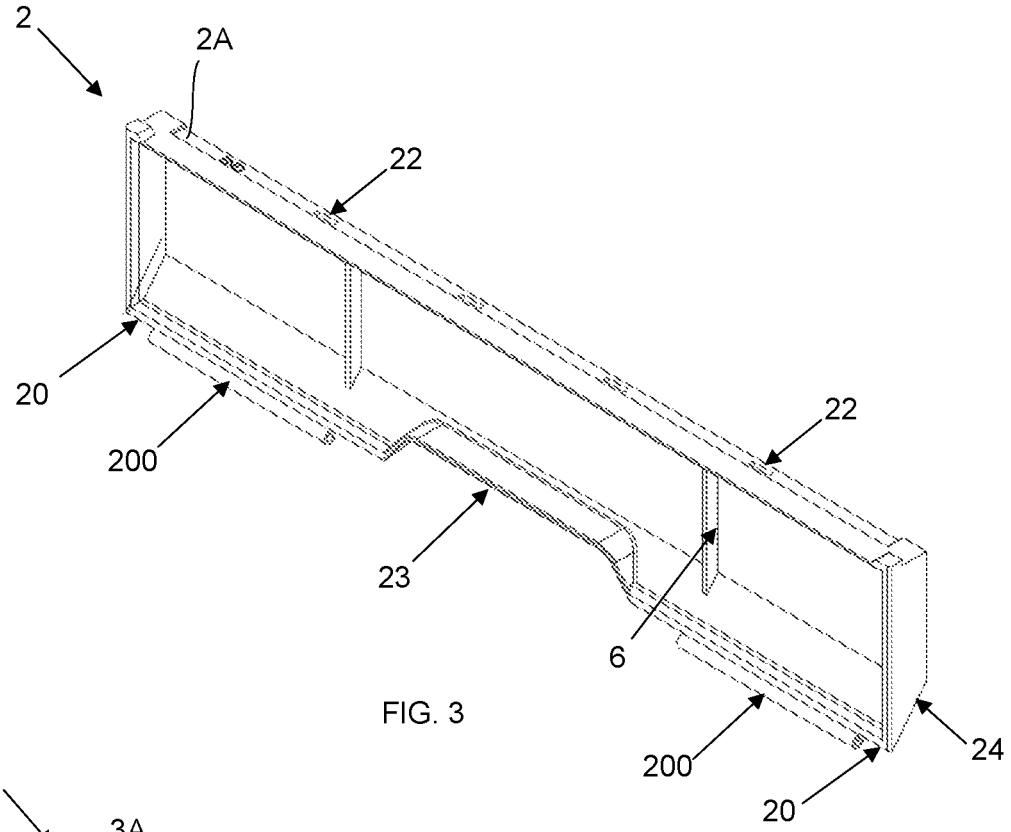
FIG. 3 illustrates a perspective view of a modular transversal wall (2)

The interchangeable dismountable hinged box (C) of the claimed invention is described with the below reference numerals:

Base (1)
Modular transvers walls (2)
Modular longitudinal walls (3)
Interchangeable modular partition (4)
Storage compartments (C1)
Core samples (t)
Upper surface (1*a*)
Lower surface (1*b*)
Edges (10)
Faces (10*a*)
Transverse connection and articulation elements (100)
Longitudinal connecting and articulating elements (101)
Lateral locking openings (21)
Upper locking openings (22)
Connecting edges (20)
Connecting elements and transverse articulation (200)
Sealing faces (20*a*)
modular longitudinal walls (3)
Upper locking shoulders (31)
Fitting recesses (32)
Connecting edges (30)
Connecting elements and longitudinal articulation (300)
Sealing faces (30*a*);
Transverse connection and articulation elements (100)
Interchangeable modular partitions (4)
Transverse ledges (40)
Top surface (42)
Recesses (41)
Separator (5)
Lateral projections (52)
Stop (102)
Inclined sealing region (24)
Ergonomic handling (23 and 33)
Structural reinforcements (6)
Lid (7)
Receiving region (C2)
Top recesses (2*a* and 3*a*)

As represented by the figures, the interchangeable dismountable hinged box (C) for storing core samples (T) comprises at least one storage compartment (C1) for core samples (T) defined between two modular transversal walls (2) and two modular longitudinal walls (3) which are assembled interchangeably between each other and the base (1). Thus, each modular wall (2 and 3) can be assembled and disassembled interchangeably, so that the base (1) can receive modular walls (2 and 3) of different dimensions, to form boxes (C) of different sizes, so that core samples (T) of different sizes can be stored in each storage compartment (C1) of said box (C).

Figure 9:
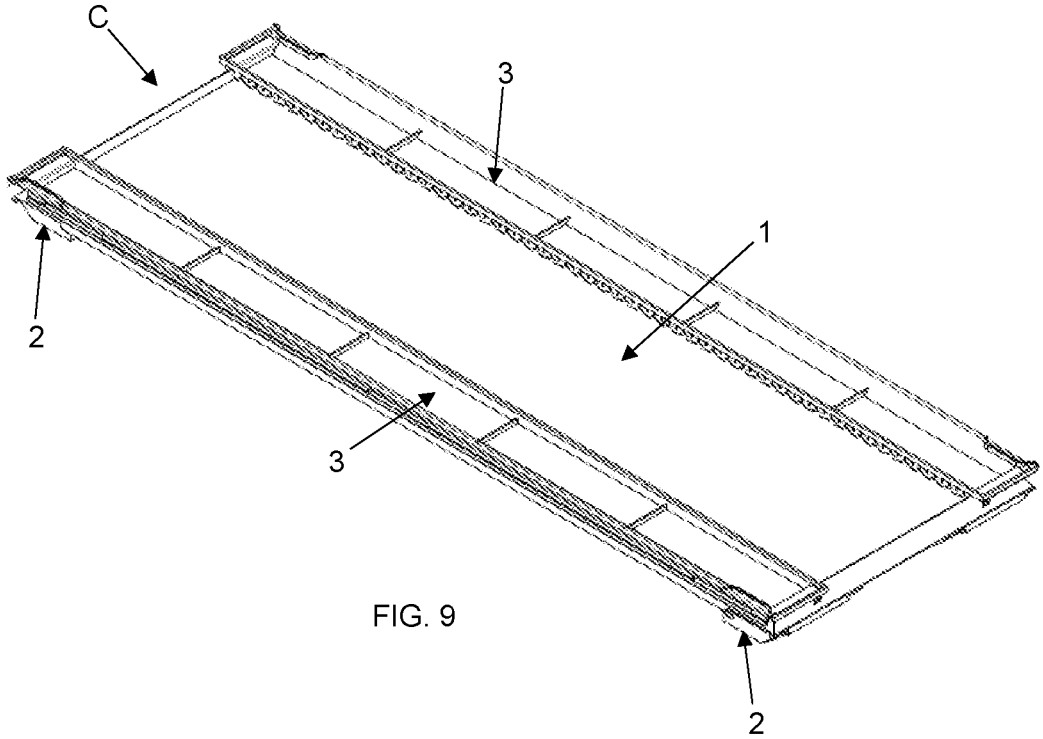
FIG. 9 illustrates a perspective view of a box (C) without internal partitions (4) in a disassembled position.

In addition to this, the assembly of the modular walls (2 and 3) is performed in such a way that each modular wall (2 and 3) is moveable between a position perpendicular to the base (1), on which the box (C) is assembled (see FIG. 7), and a position parallel to the base (1), on which the box (C) is disassembled (see FIG. 9).

As illustrated by FIGS. 2, 3, 4 and 6, to enable the assembly of each modular wall (2 and 3) on the base (1), the said base (1) comprises connecting and hinged edges (10) that can be interlocked with a connecting and hinged edge (20) of each modular transversal wall (2).

Moreover, the base (1) comprises a connecting edge (30) for each modular longitudinal wall (3). Thus, two of the connecting and hinged edges (10) receive, in an interchangeable and hinged manner, the modular transversal walls (2), while the other two connecting and hinged edges (10) receive, in an interchangeable and hinged manner, the modular longitudinal walls (3).

Figure 8:
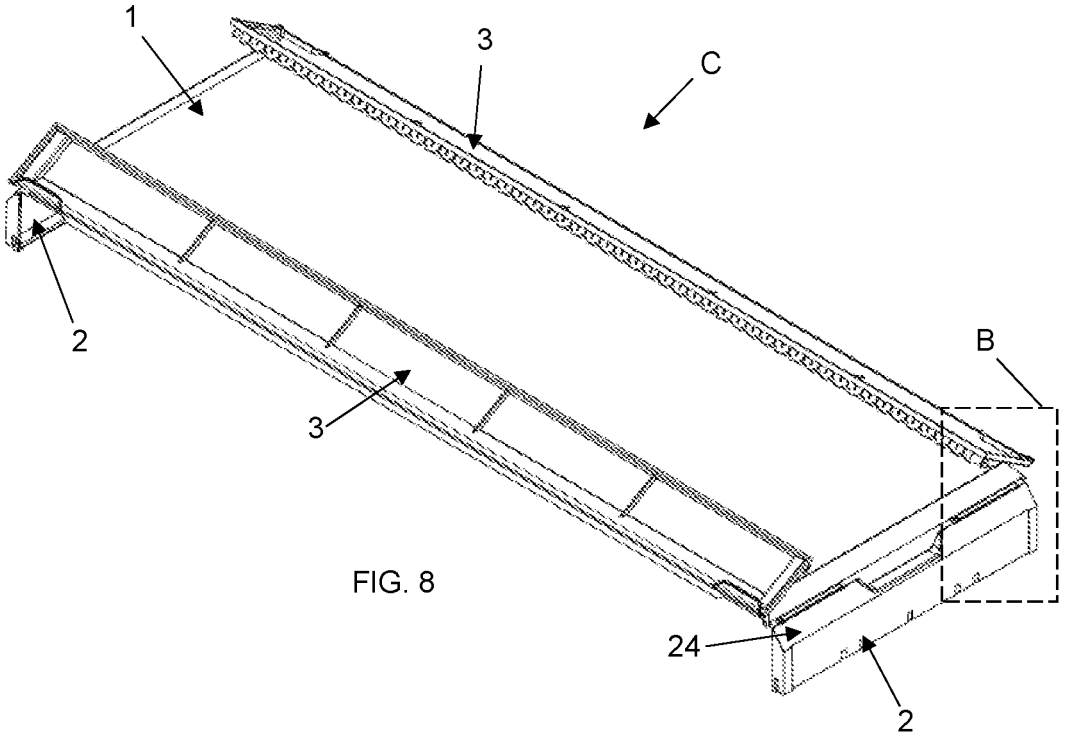
FIG. 8 illustrates a perspective view of a box (C) without internal partitions (4), showing the hinging of the modular walls (2 and 3) during the transition between an assembled position and a disassembled position.
Figure 8A:
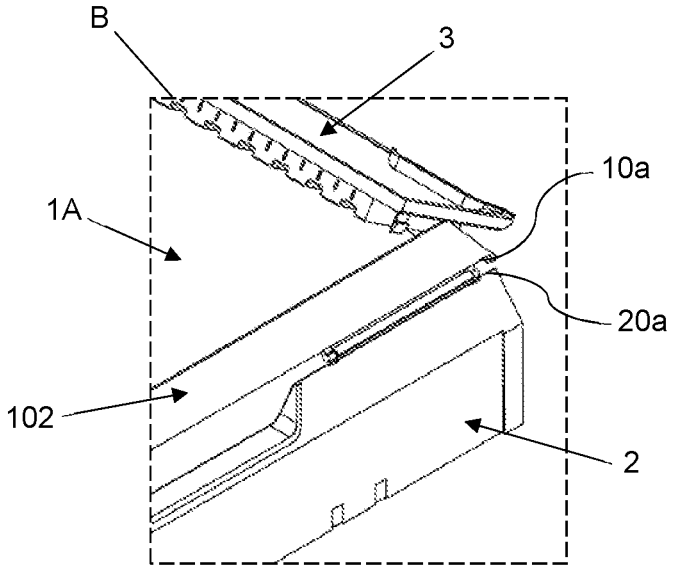
FIG. 8A illustrates an enlarged view of detail "B" of FIG. 8.

In accordance with FIGS. 8 and 8A, the sealing of each modular transversal wall (2) with the base (1) occurs through the contact of the faces (10*a*) of the base (1) and (20*a*) of each modular transversal base (2) when the box (C) is assembled.

In accordance with FIGS. 11 and 11A, the sealing of each modular longitudinal wall (3) with the base (1) occurs through the contact of the faces (10*a*) of the base (1) and (30*a*) of each modular longitudinal wall (3) when the box (C) is assembled.

Figure 12:
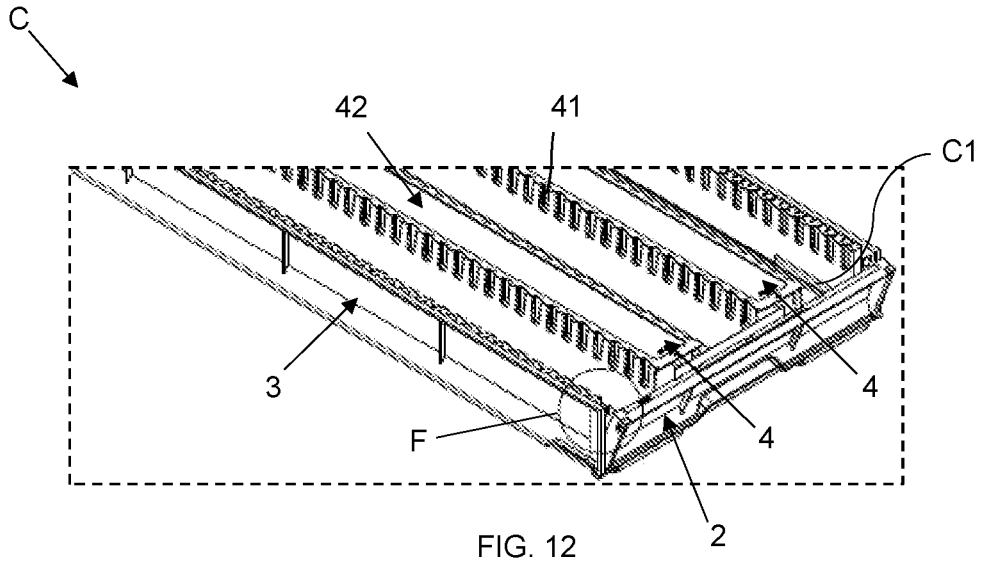
FIG. 12 illustrates a partial perspective view of a box (C), showing the hinged of a modular transversal wall (2)
Figure 12A:
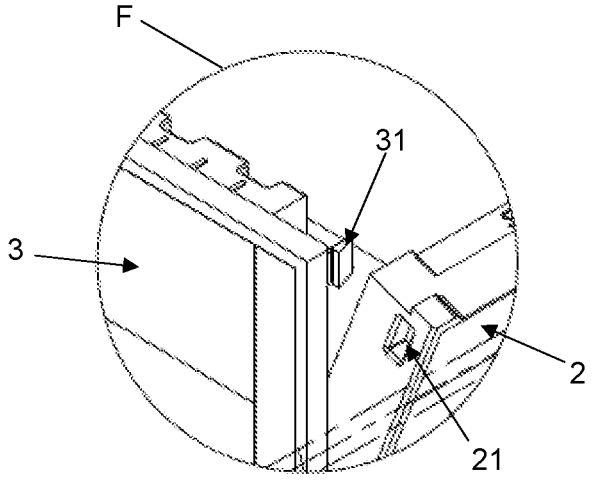
FIG. 12A illustrates an enlarged view of detail "F" of FIG. 12.

Also, in accordance with what is illustrated in FIG. 12A, to enable the interlocking between each of the modular walls (2 and 3) arranged adjacently to each other, in order to keep the box (C) in an assembled position, each modular transversal wall (2) comprises at least one lateral locking openings (21) which is interlockable with at least one upper locking shoulder (31) for each modular longitudinal wall (3).

Said locking (21 and 31) are preferably configured by pressure locking elements, also known as snap fit, which, advantageously, can be interlocked with each other and unlocked in a simple and practical manner. Also, preferably, said locking (21 and 31) are positioned in an upper region of each modular wall (2 and 3), respectively.

Preferably, each pair of perpendicular locking (21 and 31) that interlock with each other, is configured by one male type locking element and the other by a female type locking element. More specifically, each lateral locking opening (21) is configured to receive each upper locking shoulder (31), where each lateral locking openings (21) is a trapezoidal-shaped hole and each upper locking shoulder (31) is a trapezoidal-shaped projection, so as to enable the cooperative fitting and swift coupling of the modular walls (2 and 3) by mechanical interference, which may incorporate any locking system known to the state of the art, such as snap-fit, click type, pressure or similar.

Figure 13:
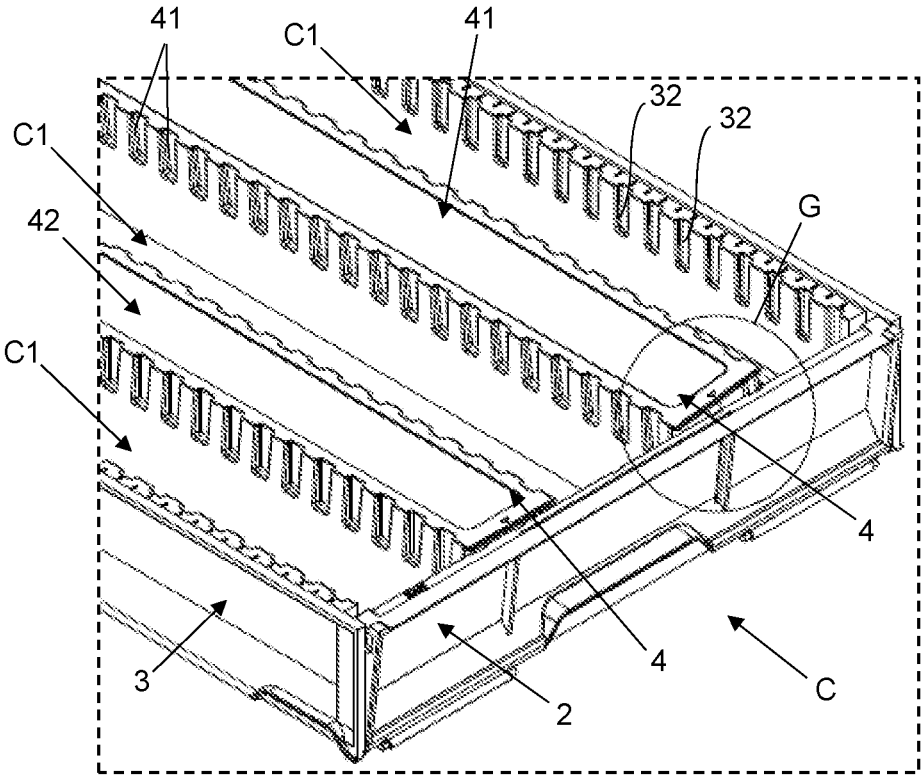
FIG. 13 illustrates a partial perspective view of a box (C), showing the fitting of an interchangeable modular partition (4) into a modular transversal wall (2)

As illustrated by FIGS. 2 and 13, said box (C) also comprises at least one top surface (4) interlockable with the modular transversal walls (2) mounted in a position perpendicular to the base (1). Thus, each interchangeable modular partition (4) is installed in the box (C) to create an additional storage compartment (C1), so that the number of interchangeable modular partitions (4) installed is compatible with the dimensions and number of storage compartments (C1) required for each use of the box (C).

Preferably, as illustrated by FIGS. 1, 12 and 13, each interchangeable modular partition (4) comprises an enlarged transversal section.

Thus, each partition with an enlarged section may comprise different dimensions in order to facilitate the assembly of boxes with a number of compartments and adequate space to receive core samples (T) with varying diameters.

In one form of embodiment of the invention, as shown in FIG. 1, the box (C) is assembled to configure 3 (three) compartments (C1) for the packing of samples (T) of a larger diameter.

In another form of embodiment of the invention, as shown in FIG. 1*a*, the box (C) is assembled in such a way as to configure 4 (four) compartments (C1) for the packing of samples (T) with a smaller diameter.

As shown in FIGS. 2, 12 and 13, each partition (4) comprises double walls, joined by a surface with an enlarged top. The surface with a top surface (42) varies in its dimensions to enable the assembly of a box (C) with a number of compartments and dimensions suitable for receiving core samples (T) of varying diameters.

In this way, each partition with an enlarged transversal section (4), in addition to fulfilling the aforementioned functions, provides greater mechanical strength to the box when assembled, and also ensures greater dimensional stability during the manufacturing process of each partition (4).

Technically, the enlarged partition (4) when interlocked with the modular transversal walls (2) provides greater structural stability to the box (C), since the interchangeable modular partitions (4) assume the function of a structural rib, in such a way as to prevent plastic deformations (twists) at the time of their handling, during the maneuvers of collection and transportation of the core samples.

Furthermore, the constructive form of the partition (4) described above, facilitates the manufacturing process of molding the thermoplastic material, since, said constructive form ensures dimensional stability during the manufacturing process, preventing potential contractions of the material.

The fact that the partition (4) has a significant length, demands the manufacture of large molds and the use of a large amount of thermoplastic material to be processed.

Overcoming these technical challenges of the manufacturing process, the partition with an enlarged section (4) is cooled without compromising its dimensions, avoiding twists along its length after the process of cooling and extracting the part.

As a result, the box (C) equipped with partitions (4) with enlarged sections can be packed with samples (T) of varying weights, keeping the structure of the box (C) stable and preserving the integrity of the samples during transportation and storage.

Figure 13A:
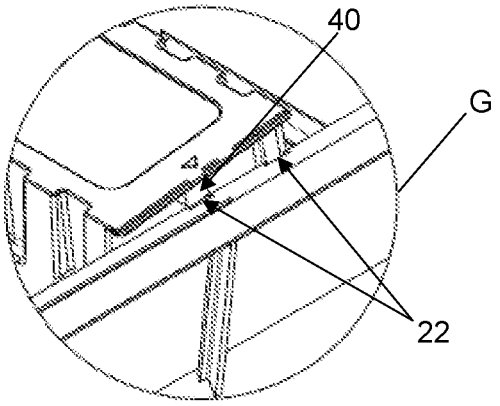
FIG. 13A illustrates an enlarged view of detail "G" of FIG. 13.

As shown in FIGS. 13 and 13A, each modular transversal wall (2) comprises at least one upper locking openings (22) interlockable with at least one transverse ledges (40) of each interchangeable modular partition (4). Preferably, each modular transversal wall (2) comprises a set of upper locking openings (22) distributed along the length of each modular transversal wall (2) in positions correspondingly aligned with the upper locking openings (22) of the other modular transversal wall (2) of the box (C). Thus, each interchangeable modular partition (4) can be interlocked in the upper locking openings (22) arranged in different positions along the modular transversal walls (2), and several interchangeable modular partitions (4) can be interlocked in these upper locking openings (22).

Figure 6:
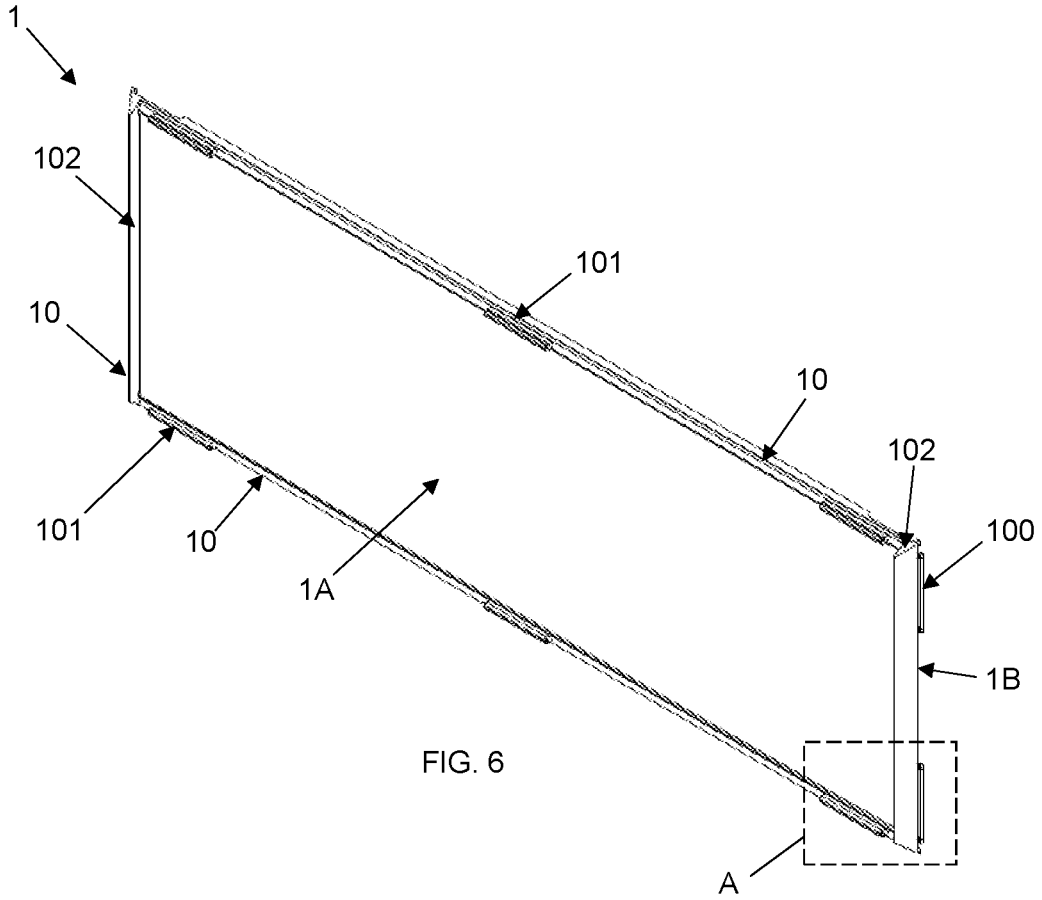
FIG. 6 illustrates a lateral perspective view of a base (1)
Figure 6A:
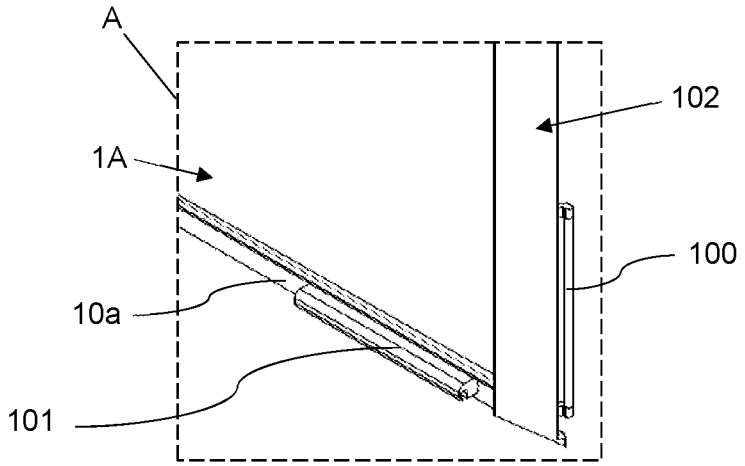
FIG. 6A illustrates an enlarged view of detail "A" of FIG. 6.

In accordance with FIGS. 3 and 6, in a preferred form of embodiment of the invention, at least two of the connecting and hinged edges (10) of the base (1) comprise at least one, and preferably two, transverse connection and articulation elements (100). Thus, each transverse connection and articulation element (100) is mounted on a connecting and hinged edge (20) in order to enable the connection of each modular transversal wall (2) with the base (1).

Figure 4:
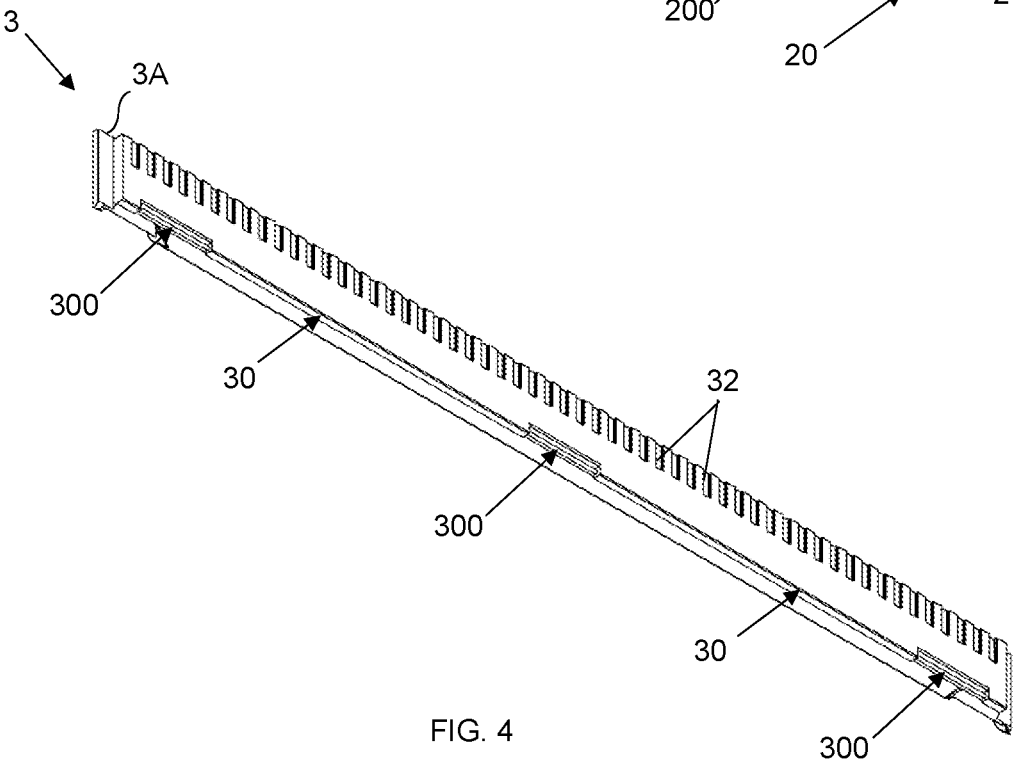
FIG. 4 illustrates a perspective view of a modular longitudinal wall (3)

In accordance with FIGS. 3, 4 and 6, in a preferred embodiment of the invention, each of the connecting and hinged edges (20) arranged on the modular transversal walls (2) comprises at least one connecting elements and transverse articulation (200) connectable under pressure to a transverse connection and articulation element (100).

Each transverse connection and articulation element (100) is responsible for allowing the assembly of a connecting elements and transverse articulation (200), so that the modular transversal wall (2) can perform a hinged movement of the modular transversal wall (2) between its assembled position (see FIG. 7), and a disassembled position adjacent to the lower surface (1B) of the base (1) (see FIG. 9).

Thus, the transverse connection and articulation element (100) of the modular base (1) and the connecting elements and transverse articulation (200) of the modular wall (2), allow each modular transversal wall (2) to be assembled and connected to the modular base (1), and to be disassembled when modular transversal walls (2) of larger dimensions are required.

Figure 10:
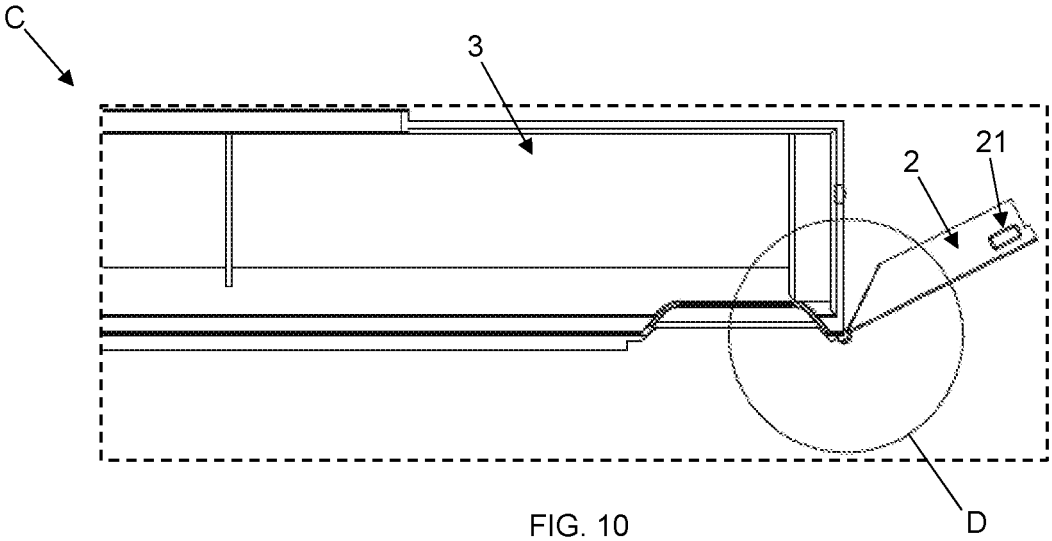
FIG. 10 illustrates a partial lateral view of a box (C), showing the hinging of a modular transversal wall (2)

In accordance with what is illustrated in FIGS. 10 and 10A, the transverse connection and articulation elements (100) do not allow the modular transversal wall (2) to be connected to the upper surface (1A) of the modular base (1), allowing them only to be connected to the bottom surface (1B) of the base (1).

Conveniently, this connecting arrangement of the modular transversal walls (2) on the lower surface (1B) of the base (1), helps to ensure that there is no involuntary unlocking of each lateral locking openings (21) of the modular transversal wall (2) between each upper locking shoulders (31) of the modular longitudinal wall (3).

Preferably, as illustrated by FIGS. 2, 3, 6 and 10A, each transverse connection and articulation element (100) is defined by a projection, preferably convex and cylindrical, integrated into the base (1) and which extends from the lower region of one of the connecting and hinged edges (10). In turn, each connecting element and transverse articulation (200) is defined by a projection, preferably concave and cylindrical, integrated into one of the modular transversal walls (2) and which extends from the lower region of one of the connecting and hinged edges (20) to be fitted under pressure into the transverse connection and articulation elements (100).

In accordance with FIG. 6, in a preferred embodiment of the invention, at least two of the connection hinged edges (10) of the base (1) may comprise at least one, and preferably three, longitudinal connecting and articulating elements (101) of a modular longitudinal wall (3) in relation to the base (1).

Thus, each connecting and hinged edge (10) may comprise one or more transverse connection and articulation elements (100) or one or more longitudinal connecting and articulating elements (101).

It will be understood that each connecting and hinged edge (10) can receive transverse connection and articulation elements (100) or longitudinal connecting and articulating elements (101), since, said transverse connection and articulation elements (100) determine the connection of the walls (2 and 3) to the lower region (1B), while each longitudinal connecting and articulating element (101) determines the connection of the modular walls (2 and 3) to the upper region (1A) of the base (1).

In accordance with what is illustrated in FIG. 4, in the preferred form of embodiment of the invention, each of the connecting edges (30) of at least two of the modular longitudinal walls (3) may also comprise at least one, and preferably three, connecting elements and longitudinal articulation (300) that can be fitted to the longitudinal connecting and articulating element (101), under pressure in this longitudinal connecting and articulating element (101).

Each longitudinal connecting and articulating element (101) is responsible for allowing the assembly of a connecting element and longitudinal articulation (300), so that the modular longitudinal wall (3) can perform a hinged movement between its assembled position and a position adjacent to the upper surface (1A) of the base (1).

Preferably, as illustrated by FIGS. 2, 4 and 6, each longitudinal connecting and articulating element (101) is defined by a projection, preferably convex and cylindrical, integrated into the base (1) and which extends from the upper region of one of the connecting and hinged edges (10). In turn, each connecting element and longitudinal articulation (300) is defined by a recess, preferably concave and cylindrical, integrated with one of the modular longitudinal walls (3) and inserted into the lower region of one of the connecting edges (30) to be fitted under pressure into the projection determined by a longitudinal connecting and articulating element (101) (see FIG. 11A).

Figure 7:
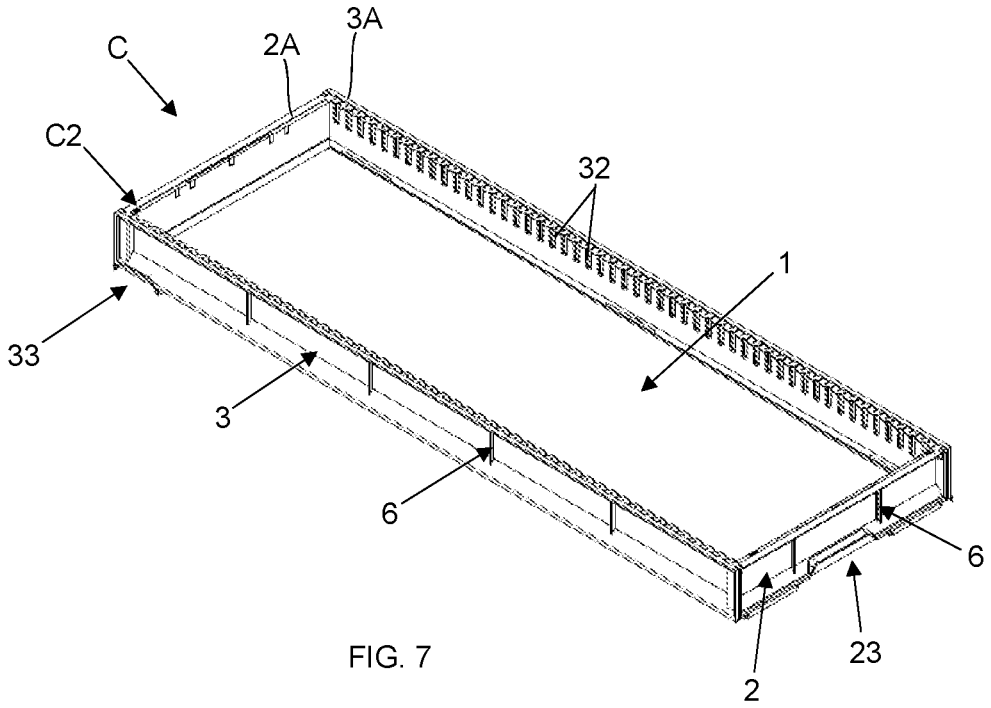
FIG. 7 illustrates a perspective view of a box (C) without internal partitions (4) in an assembled position.

As illustrated in FIGS. 7, 8 and 9, the modular transversal walls (2) can be connected between their assembled position, and a position adjacent to the lower surface (1B) of the base (1), while the modular longitudinal walls (3) can be connected between their assembled position, and a position adjacent to the upper surface (1A) of the base (1).

Furthermore, as illustrated by FIGS. 6 and 11, each of at least two of the connecting and hinged edges (10) comprises at least one stopper (102) to limit the hinging of each modular transversal wall (2).

In the preferential form of embodiment of this invention, two connecting and hinged edges (10) comprise at least one stopper (102) to limit the hinging of each modular transversal wall (2). Furthermore, each modular transversal wall (2) comprises an inclined sealing area (24) which prevents the modular transversal wall (1) from encroaching on each stopper projection (102). This limitation of movement prevents the hinging of the modular transversal walls (2) towards the upper surface (1A) of the base (1), preventing the disconnection between the modular transversal walls (2) and the modular longitudinal walls (3).

Thus, each stopper (102) is a point of support of the inclined region (24) of the modular transversal wall (2) with the base (1), which advantageously prevents the involuntary dismantling of the box (C).

Furthermore, in accordance with what is illustrated in FIG. 7, each modular transversal wall (2) comprises at least one ergonomic handling region (23) to facilitate the gripping and handling of the box (C) by a human operator.

In addition to this, preferably each modular longitudinal wall (3) also comprises at least one ergonomic handling region (33) to facilitate gripping and handling of the box (C) by a human operator.

The handling region (23) is located in the lower portion of each modular transversal wall (2), while each handling region (33) is located in the lower portion of each modular longitudinal wall (3), in order to prevent the unlocking of the walls (2 and 3) during the lifting of the box (C). Thus, unlocking does not occur because each handling region (23 and 33) is arranged in a manner contrary to the locking (21 and 31) between the modular transversal walls (2) and the modular longitudinal walls (3).

As illustrated by FIG. 13, each modular longitudinal wall (3) also comprises a plurality of fitting recesses (32) respectively aligned with a plurality of fitting recesses (41) for receiving the separators (5), where the fitting recesses (41) are distributed along the length of each interchangeable modular partition (4). Thus, each separator (5) can be positioned in the fitting recesses (32 and 41) aligned with each other, as necessary to create separations between core samples (T) arranged in the storage compartments (C1), in accordance with the differences in length of each stored core sample (T).

Figure 5:
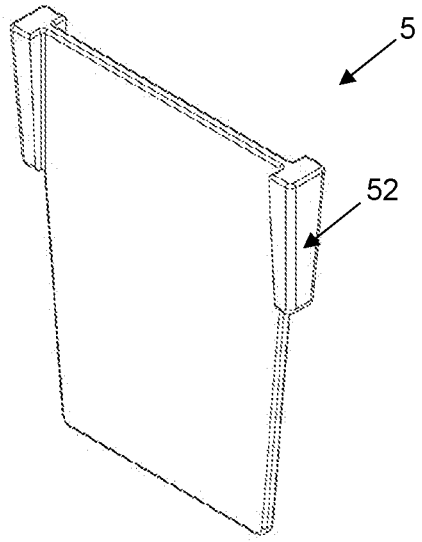
FIG. 5 illustrates a perspective view of a separator (5)

In accordance with FIG. 5, the separator (5) comprises a tapered geometry and is equipped with lateral projections (52) that can be fitted into the fitting recesses (32 and 41) arranged along the partitions (4) and modular longitudinal walls (3). The tapered shape of the separator facilitates insertion and allows for practical placement, keeping it static.

The box (C) also comprises a lid (7) for closing the box (C) that rests on a receiving area (C2) which is defined by the alignment of top recesses (2A and 3A) arranged on the modular walls (2 and 3), respectively, when the said modular walls (2 and 3) are in the assembled position.

Finally, the box (C) also comprises a plurality of structural reinforcements (6) distributed along the modular walls (2 and 3), preferably defined by vertical ribs, responsible for increasing the structural strength of these modular walls (2 and 3).

The invention claimed is:

1. An interchangeable dismountable hinged box for storing core samples comprising:

a base, two modular transverse walls, two modular longitudinal walls, and at least one interchangeable modular partition which forms at least two storage compartments for core samples; wherein the base comprises an upper surface, a lower surface, edges, and sealing faces, said edges provided with transverse hinge elements and longitudinal hinge elements;

the modular transverse walls comprise a female locking element, upper openings for positioning at least one interchangeable modular partition, and connecting edges, each connecting edge being provided with a hinge element and a sealing face;

the modular longitudinal walls comprise a male locking element for mating with the female locking elements of the modular transverse walls, which when engaged, lock the modular transverse and longitudinal walls in an upright position, fitting recesses, and connecting edges, each of said connecting edges being provided with a hinge element and a sealing face;

wherein the modular transverse walls and the base are connected through the transverse hinge elements of the base and the hinge elements of the modular transverse walls, said connection allows the modular transverse walls to pivot with respect to the base between an assembled and a folded position, wherein in the folded position, each modular transverse wall is against the lower surface of the base;

wherein the modular longitudinal walls and the base are connected through the longitudinal hinge elements of the base and the hinge elements of the modular longitudinal walls, said connection allows the modular longitudinal walls to pivot with respect to the base between an assembled and a folded position, wherein in the folded position, each modular longitudinal wall is against the upper surface of the base;

wherein when in the assembled positions, the sealing faces of the modular transverse walls and the sealing faces of the modular longitudinal walls mate with corresponding sealing faces of the base thereby providing a sealed contact;

wherein at least one of the interchangeable modular partitions has double walls, the double walls are connected via an enlarged top surface that closes a space between the double walls, and at least one protrusion that mates with at least one of the upper openings of the modular transverse walls to interlock the interchangeable modular partitions with the modular transverse walls; and wherein each interchangeable modular partition is provided with a plurality of fitting recesses that cooperate with the fitting recesses on the modular longitudinal walls in order to receive a separator.

2. The interchangeable dismountable hinged box for storing core samples according to claim 1, wherein each transverse hinge element of the base is defined by a projection integrated with the base and projecting from the lower surface of the base; and each hinge element of the transverse modular walls is defined by an integrated projection extending from a respective connecting edge of the transverse modular wall and is configured to be snap-fitted with the transverse hinge elements.

3. The interchangeable dismountable hinged box for storing core samples according to claim 2, wherein the transverse hinge elements and hinge elements of the transverse modular walls are convex and cylindrical.

4. The interchangeable dismountable hinged box for storing core samples according to claim 1, wherein each longitudinal hinge element of the base is defined by a projection integrated with the base and projecting from the upper surface of the base; and each hinge element of the longitudinal modular walls is defined by an integrated projection extending from a respective connecting edge of the longitudinal modular wall and is configured to be snap-fitted with the longitudinal hinge elements.

5. The interchangeable dismountable hinged box for storing core samples according to claim 1, wherein each longitudinal hinge element is defined by a convex and cylindrical projection integrated with the base and projecting from the upper surface of the base; and each hinge element of the longitudinal modular walls is defined by an integrated concave and cylindrical recess which is fitted with each respective longitudinal hinge element.

6. The interchangeable dismountable hinged box for storing core samples according to claim 1, wherein each base edge having transverse hinge elements comprises at least one stop limiting the advance of a respective modular transverse wall from moving toward the upper surface of the base past a certain extent in order to prevent unintentional disengagement between the modular transverse walls and the longitudinal transverse walls when in the assembled position.

7. The interchangeable dismountable hinged box for storing core samples according to claim 6, wherein each modular transverse wall comprises a lower portion with an inclined sealing area that prevents the modular transversal wall from encroaching on the respective limiting stop and at least two ergonomic handling regions.

8. The interchangeable dismountable hinged box for storing core samples according to claim 1, further comprising a lid for closing the box, wherein the lid rests in a receiving area defined by a top recess in each of the two modular transverse and longitudinal walls, and wherein a plurality of structural reinforcements are distributed along each modular transverse and longitudinal wall.

* * * * *